United States Patent [19]

Bock et al.

[11] Patent Number: 4,964,336

[45] Date of Patent: Oct. 23, 1990

[54] PRINTING MACHINE WITH SEPARABLE COMPACT INKER INCLUDING A CHAMBERED DOCTOR BLADE UNIT

[75] Inventors: Georg Bock, Augsburg; Franz X. Gollinger, Hirschbach; Thomas John, Augsburg, all of Fed. Rep. of Germany

[73] Assignee: Man Roland Druckmaschinen AG, Offenbach am Main, Fed. Rep. of Germany

[21] Appl. No.: 403,620

[22] Filed: Sep. 6, 1989

[30] Foreign Application Priority Data

Sep. 22, 1988 [DE] Fed. Rep. of Germany ..... 3832216

[51] Int. Cl.[5] ..... B41F 9/10; B41F 31/04

[52] U.S. Cl. ..... 101/157; 101/349

[58] Field of Search ..... 101/157, 348, 349, 350

[56] References Cited

U.S. PATENT DOCUMENTS

| | | | |
|---|---|---|---|
| 2,377,110 | 5/1945 | Smith | 101/350 |
| 2,377,482 | 6/1945 | Crafts | 101/157 |
| 3,566,787 | 3/1971 | Moos | 101/350 |
| 4,085,672 | 4/1978 | Grosart | 101/120 |
| 4,590,855 | 6/1984 | Schommer et al. | 101/350 |
| 4,879,949 | 11/1989 | Vennike | 101/350 |

FOREIGN PATENT DOCUMENTS 3704433 8/1988 Fed. Rep. of Germany .

*Primary Examiner*—Edgar S. Burr
*Assistant Examiner*—John S. Hilten
*Attorney, Agent, or Firm*—Frishauf, Holtz, Goodman & Woodward

[57] ABSTRACT

A chambered doctor blade unit (1) has at least one doctor blade (7, 8; 32) projecting from leading edges of a generally U-shaped or channel-shaped rail element, closed off at the lateral ends by side walls (4) to form the unit so that it can be inexpensively made by extrusion, rolling or other simple profiled rail forming machinery. A rear wall of the unit is formed with an elongated slit (12), preferably narrower in the middle. The unit (1) can be releasably coupled to a carrier (2) by interlocking rotatable pins (22) formed with projecting locking cams (23) with grooves or recesses (25) formed in bolts projecting from a rear surface (10) of the chambered doctor blade unit (1). The chambered doctor blade unit (1) thus can be readily removed by rotating the pins by handles (26), not requiring tools, and maximum ink distribution is ensured by the elongated slit which receives ink via a flattened funnel-shaped distribution duct (16) coupled to the holder unit (2).

12 Claims, 1 Drawing Sheet

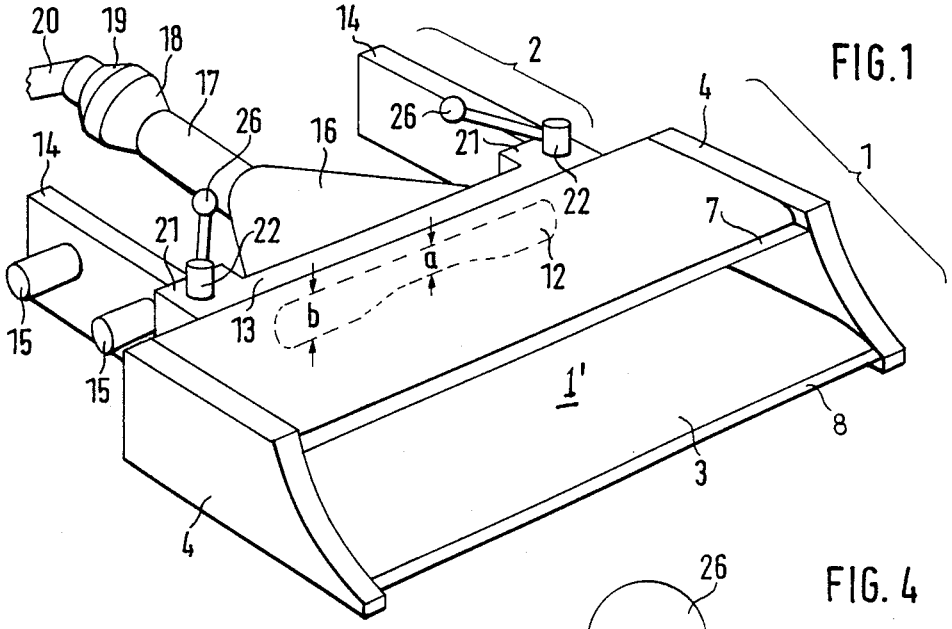
FIG.1
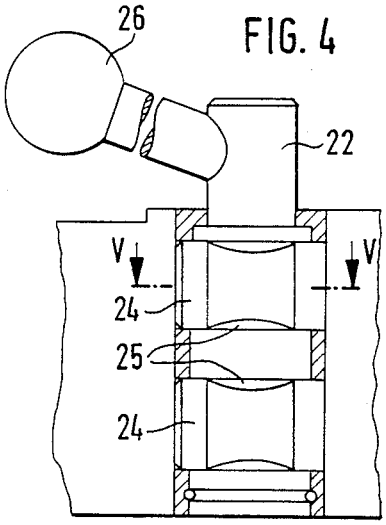
FIG. 4
FIG. 2
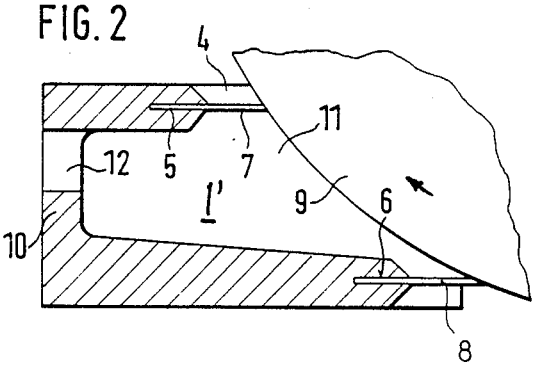
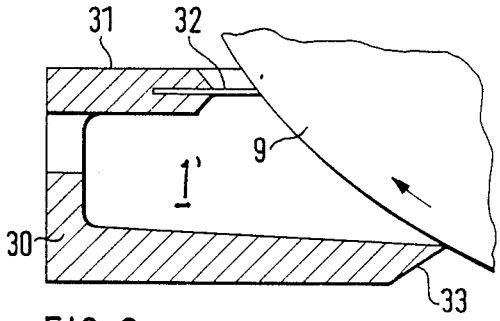
FIG.3
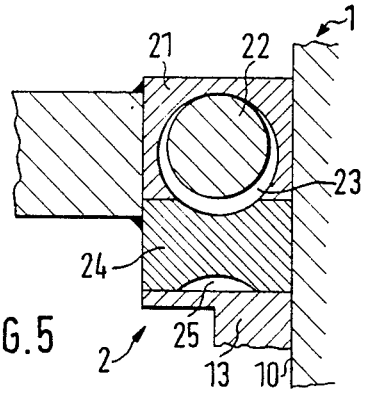
FIG.5

PRINTING MACHINE WITH SEPARABLE COMPACT INKER INCLUDING A CHAMBERED DOCTOR BLADE UNIT

Reference to related applications, assigned to the assignee of the present application, the disclosures of which are hereby incorporated by reference:

U.S. Ser. No. 07/403,754, filed, Sept. 6, 1989 JOHN

U.S. Ser. No. 07/403,760, filed, Sept. 6, 1989, BOCK et al. ps Reference to related literature:

"Technik des Flexodrucks" ("Technology of Flexography"), Coating Verlag Thomas & Co., publishers.

German Patent No. 37 04 433, Norbert KOBLER et al. U.S. Pat. No. 4,085,672 the disclosure of which is hereby incorporated by reference.

FIELD OF THE INVENTION

The present invention relates to printing machines, and more particularly to compact inkers for any printing machine and especially for offset or flexography machines which can be easily exchanged or replaced on the printing machine.

BACKGROUND

Chambered doctor blade units, that is, doctor blade assemblies to strip ink off an anilox roller of a flexographic printing machine in which ink is supplied between two doctor blades to an ink chamber have been described in the literature reference "Technology of Flexography", Coating Verlag Thomas & Co., publishers. One form of such a chambered doctor blade is also shown in German Patent No. 37 04 433. These chambered doctor blade units are usually so constructed that an ink chamber or ink reservoir is at least partially bounded by two doctor blades, which each are secured to a carrier element forming the back-up or back structure for the doctor blades, see for example the referenced German Patent No. 37 04 443. Clamping strips attach the doctor blades to the holding structure. When the doctor blades are worn, it is possible to loosen the clamping connection by loosening screws, and replacing the doctor blade. Such chambered doctor blade units require substantial manufacturing effort since they are made of a plurality of parts which are releasably coupled together. Inserting a new doctor blade into an existing holding structure of the chambered unit requires care and skill to accurately align the front edge of the doctor blade parallel to the axis of the anilox roller which it is intended to strip.

U.S. Pat. No. 4,085,672, shows a structure which is closed all around, except for the opening to permit application of ink to an anilox roller and for an ink inlet opening. Ink is supplied to the chamber through a plurality of tubes or pipes. If it is necessary to replace the chambered doctor blade unit, a substantial number of couplings must be released. These couplings are formed as screw connections and also include a plurality of unions or pipe couplings for the respective ink supply tubes. Lateral distribution of the ink occurs, effectively, essentially only within the ink supply chamber.

When the chambered doctor blade unit is attached to a printing machine, a groove will match up with a marker on the machine to provide an indication for proper seating of the chambered unit, and to facilitate placing the chambered unit in appropriate position. The chambered doctor blade unit can be clamped and, although not shown, it is customary to clamp such units by screws or the like, since they are not further shown.

German Patent No. 37 04 433 also shows a chambered doctor blade unit in which a solid structural element is formed with an axially extending cross bore from which distribution bores extend directly into the chamber which then supplies ink to the anilox roller. The general idea is to distribute ink in the chamber before it actually reaches the chamber through the plurality of axially staggered exit openings or nozzles. The ink distribution duct, extending axially parallel to the anilox roller, thus is actually outside of the chamber structure of the chambered doctor blade unit.

THE INVENTION

It is an object to provide a chambered doctor blade unit for association with a printing machine, which is easy to make, inexpensive to construct and contains a minimum of separable parts which have to be carefully machined and matched with respect to each other, which, further, facilitates alignment of the doctor blades when the entire unit is placed on a printing machine, and which, further, permits easy removal, assembly, or interchange of chambered doctor blade units on the printing machine without requiring special or external tools, while providing for reliable seating of the doctor blade unit in proper position on the printing machine. The chambered doctor blade unit, further, should ensure that the lateral distribution of the ink within the chambered unit provides ink to all axial regions while still permitting simple and inexpensive manufacture and while allowing ready removal or exchange of the unit.

Briefly, the chambered doctor blade unit is formed of an elongated structure which defines therein a cavity open at one side towards the inking roller, typically the anilox roller. At least one doctor blade, and preferably two doctor blades, are securely, essentially irremovably seated at facing end walls of the structure, projecting from the cavity towards the inking roller to strip ink therefrom. In accordance with a feature of the invention, the doctor blades are fitted into slits formed in the elongated structure. The slits extend axially; reference herein to "axial" is intended to refer to the axis of the associated inking roller.

The chambered doctor blade unit, in accordance with a feature of the invention, is coupled to the machine by releasable interlocking attachment elements respectively located on a carrier element for the elongated structure, and on the elongated structure itself, to readily releasably couple the entire elongated doctor blade structure to the carrier. The chambered doctor blade structure is formed with an ink supply opening terminating in the rear or bottom wall of the cavity which is in the form of an elongated ink supply and distribution slit which extends axially of the structure. An ink supply and distribution connection is coupled to the elongated slit, and fitted against the rear wall of the elongated structure, the ink supply and distribution connection being a funnel-like structure covering the elongated ink supply and distribution slit along its length.

In accordance with a feature of the invention, the releasable interlocking attachment is formed by at least two projecting elements, such as bolts, which project from the end face of the elongated structure facing the carrier element. The bolts or projections are formed with grooves or recesses, for example essentially partcircular notches, into which rotatable bolts secured to the carrier structure and having a camming surface engageable into the notches, can be rotated. Upon rotation of the engagement bolts, for example by hand levers, the projecting bolts with their grooves and the eccentric or cam-like portions of the rotatable bolts will interlock, pull the chambered doctor blade unit structure against the carrier, and provide a tight fit for the ink distribution and supply connection while, when desired to remove the chambered doctor blade unit, it is merely necessary to rotate the bolts by the hand levers.

In accordance with another feature of the invention, the chambered doctor blade unit is made of strip elements or rails having a generally U-shaped or channel configuration, with a back wall or cross portion of the U forming the back or bottom wall of the cavity defining the ink chamber, closed off at the axial ends by side walls fitted thereagainst. This is an easily made structure, readily cut to desired length to fit various types and sizes of printing machines, or width requirements of inkers; the channel-shaped structure can be merely an extruded structure, thus simplifying manufacture and lowering overall cost thereof.

DRAWINGS:

FIG. 1 is a schematic perspective view of a chambered doctor blade unit in accordance with the present invention, attached to a holder or carrier element;

FIG. 2 is a vertical sectional view through the chambered doctor blade unit of FIG. 1;

FIG. 3 illustrates another form of the chambered doctor blade unit in vertical cross section;

FIG. 4 is a vertical part-sectional view through the interlocking attachment element; and FIG. 5 is a section along line V—V in FIG. 4.

DETAILED DESCRIPTION.

The chambered doctor blade unit 1, FIGS. 1 and 2, is coupled to a carrier 2. Basically, the ink supply unit 1 is formed of a base body 3, of generally channel or U-shaped construction, and two side walls 4, fluid-tightly secured to the unit 3. The side walls can be identical and can be coupled to the channel structure 3, in dependence on materials used, by screw connections, welding, adhesives, or merely interlocking pin-and-socket or reception hole connections, for example suitably clamped or adhered together. The elongated U-shaped structure has grooves 5, 6 at the end walls thereof, facing an inking roller, for a flexographic printer an anilox roller 9. The U-shaped structure 3 can be an extruded rail element formed as a bent and shaped metal body, a casting, an extrusion, a rolled rail, or any other similarly made structure which, preferably, is made in units of substantial length. The required portion of this base structure is then cut therefrom so that chambered doctor blade units of desired lengths can be easily provided from one base rail element.

The structure as described has the advantage that the same starting material can be used for many different chambered doctor blade units associated with machines of different cylinder or printing widths.

The forward, with respect to the anilox roller 9, facing ends of the rail structure 3, are formed with grooves 5, 6, in which doctor blades 7, 8 are seated. When the chambered doctor blade unit is in operative condition, the doctor blades engage against the anilox roller 9. The blades 7, 8 can be secured in the grooves by press fits, cast in the grooves, rolled in, or adhered therein. When the entire unit 1 is made, the spacing of the front edge of the doctor blades 7, 8 from a finished, smooth rear wall 10 (FIG. 2) of the unit can be easily predetermined. This, then, also ensures that the edges of the blades 7, 8 will be parallel to the engagement surfaces against the anilox roller 9 which, also, would be parallel to the finished rear surface 10. It is then not necessary to provide for separate adjustment of the blades 7, 8. When the blades 7, 8 are worn, the entire unit 1 can be replaced; the danger of improper exchange and adjustment of the doctor blades in the printing shops themselves no longer pertains. Unit 1 is also known as a doctor blade ink chamber.

Forming the unit 1 of a pre-manufactured or predesigned rail unit with separate side walls 4 permits inexpensive and simple manufacture. Additionally, preparation of the chamfered doctor blade units with different widths does not pose any problems. The chambered doctor blade units, further, are easily cleaned since it is built of smooth contours without any projecting or separately fitted parts.

The base body 3, side walls 4 and doctor blades 7, 8 define an ink chamber 1' which is open at the front 11, to form an ink application opening and, further, is formed with an ink inlet opening 12 at the rear or bottom wall of the chambered doctor blade unit 1. As best seen in FIG. 1, the ink supply opening 12 is an elongated slit extending essentially parallel to the ink application opening 11. In accordance with a feature of the invention, the slit is slightly bone-shaped, with a narrower central portion a and slightly enlarged marginal portions b. This particular shape, as best seen in FIG. 1, improves distribution of ink within the ink chamber 1' of the chambered doctor blade unit 1.

The doctor blade unit 1 is attached to a printing machine by a holder unit 2. The holder unit 2 includes a base plate 13 (FIG. 5) on which two strips 14 with projecting bolts 15 are connected. The bolts 15 are used to hook in the combination of the chambered doctor blade unit 1 and the holder unit 2 into suitable hook-shaped projections on a printing machine attachment element, as described in detail in copending application Ser. No. 07/403,760, filed Sept. 6, 1989. An ink supply connecting element 16 is secured to the base plate 13.

In accordance with preferred feature of the invention, the ink supply element 16 is in form of a flattened funnel, expanding funnel-like towards the slit 12 in the chambered doctor blade unit 1. The union 18 is then connected to a matching coupling element and an ink supply hose 20.

In accordance with a feature of the invention, the chambered ink supply unit 1 and the carrier 2 can be released from each other simply and easily. To provide for such a severable release without bolts or other elements requiring tools, pins 22 are rotatably located on projections 21 extending from the base plate 3, see FIGS. 4 and 5. The pins 22 are formed with eccentric, essentially circular locking cam portions 23 extending eccentrically with respect to the axis of rotation of the pins 22. The locking cam 23 interlocks with bolts 24 which are coupled securely to the chambered doctor blade unit 1, and which can be introduced in suitable bores formed in the extension 21 of the base plate 13. The bolts 24 are each formed with a recess 25. As best seen in FIG. 5, the locking cams 23, upon rotation of the pin 22 by a handle 26, can be introduced into the recess 25 of the bolt 24, and thereby interlock the holder 2 with the chambered doctor blade unit 1. Additionally, the arrangement clamps the holder 13 against the end wall 10 of the chambered doctor blade unit 1 which, preferably, is smooth so that the base plate 13 is securely clamped against the engagement surface 10 of the unit 1. This also ensures a fluid-tight coupling of the flat funnel 16 against the opening 12 in the unit 1.

The rotatable cam-grooved or recessed bolt connection as described and shown in FIGS. 4 and 5 is a preferred form, since it is simple, easy to make, and highly reliable. Other interlocking arrangements rather than the ones shown and described in connection with pin 22, cam 23 and interlocked with recess 25 of the bolts 24 can be used; the important feature is to provide a secure coupling between the holder unit 2 and the chambered doctor blade unit 1 which, still, is easily releasable without requiring separate tools.

FIG. 3 illustrates a modified form of chambered doctor blade unit 30, having a rail element with only one doctor blade 32 seated in the upper leg 31 thereof. The lower leg 33, and forming a strip-off edge, can be machined to be spaced slightly from the anilox roller 9. FIG. 3 illustrates the lower edge 33 in engagement with the anilox roller 9 because the spacing is so small as not to be visible in the drawing.

Various changes and modifications may be made within the scope of the inventive concept.

We claim:

1. Printing machine having a compact inker comprising a chambered doctor blade unit (1) having an elongated structure (3, 4) defining therein a cavity (1) open at one side (11) and facing an inking roller (9), said doctor blade unit (1) including at least one doctor blade (7, 8, 32) securely, essentially irremovably seated in said structure and projecting from said cavity towards the inking roller (9) for stripping ink therefrom;

a carrier element (2) for said elongated structure including attachment means (15) for coupling the carrier element to the printing machine;

releasable interlocking attachment means (22–26) on said carrier element (2) and on said elongated structure (3, 4) forming the chambered doctor blade unit for releasably coupling the entire chambered doctor blade unit (1) to the carrier element and hence to the printing machine;

an ink supply opening formed in said chambered doctor blade unit (1) and terminating in a rear or bottom wall (10) defining said cavity (1'), said ink supply opening comprising an elongated ink supply and distribution slit (12) extending along a major portion of said elongated structure;

an ink distribution and supply connection (16) coupled to the elongated structure, fitting against the rear wall thereof, and expanding funnel-like to cover said elongated ink supply and distribution slit;

and wherein the width of said elongated slit (12) is narrower in a central region (a) thereof than at terminal regions (b) located close to the lateral ends of the ink chamber (1').

2. The printing machine of claim 1, wherein said chambered doctor blade unit comprises a shaped profile rail element (3) of generally U-shaped or channel-shaped cross section;

and end walls (4) separate from said rail element (3) fitted against a portion or section of said rail of predetermined length to close off said U-shaped or channel-shaped rail at the sides and define said ink chamber (1').

3. The printing machine of claim 2, further including grooves (5, 6) formed in the surface portions of the legs of said U-shaped or channel-shaped rail;

and wherein said doctor blades (7, 8, 32) are seated essentially irremovably in said grooves.

4. Printing machine having a compact inker removable as a unit from the printing machine, comprising a chambered doctor blade unit (1) having an elongated structure (3, 4) defining therein a cavity (1') open at one side (11) and facing an inking roller 9, said doctor blade unit (1) including at least one doctor blade (7, 8, 32) securely seated in said structure and projecting from said cavity towards the inking roller (9) for stripping ink therefrom, and an ink supply opening formed in said elongated structure terminating in a rear or bottom wall (10) defining said cavity (1');

a carrier unit (2) for said elongated structure including attachment means (15) for coupling the carrier element to the printing machine;

releasable interlocking interengaging attachment means (22–26) on said units (1, 2) for releasably coupling the chambered doctor blade unit (1) to the carrier unit (2) and hence to the printing machine for ready removal or assembly of said doctor blade unit, as a whole, from or on said carrier unit (2);

and wherein said releasable interlocking interengaging attachment means comprises at least one rotatable pin (22) positioned on one (2) of said units and having an eccentrically projecting locking cam (23) formed thereon;

and wherein at least one projecting bolt (24) extends from a surface (10) of the other (1) of said units, said bolt being formed with at least one groove or recess (25) dimensioned and positioned for interengagement with the projecting cam (23) of the pin (22) upon rotation of the pin.

5. The printing machine of claim 4, wherein a plurality of said rotatable pins (22) are provided, located on the carrier unit (2) and a plurality of projecting bolts (24) project from the chambered doctor blade unit (1).

6. The printing machine of claim 4, further including a manually rotatable operating handle (26) coupled to said pin (22) for rotating the pin for selective engagement and release of said eccentric cam (23) from the recess or groove (25) of the bolt (24).

7. The printing machine of claim 4, wherein said carrier unit (2) is formed with a flat base plate (13) facing the chambered doctor blade unit (1); and the chambered doctor blade unit (1) is formed with a smooth end wall (10) for engagement against said flat plate upon clamping of the doctor blade unit (1) by said interlocking, interengaging attachment means on said carrier unit.

8. The printing machine of claim 4, wherein said chambered doctor blade unit (1) is formed with a flat rear wall (10) facing said carrier unit (2);

the bolt (24) projects from said surface (10) and said pin (22) is located on said carrier unit (2);

the ink supply opening is a slit (12) formed in the rear wall of said chambered doctor blade unit (1), penetrating said surface (10); and a flat funnel-shaped ink supply and distribution element (16) is secured to said carrier unit (2) in alignment with said slit.

9. The printing machine of claim 8, wherein the width of said elongated slit (12) is narrower in a central region (a) thereof than at terminal regions (b) located close to the lateral ends of the ink chamber (1').

10. Printing machine having a compact inker comprising a chambered doctor blade unit (1) having an elongated structure (3, 4) defining therein a cavity (1) open at one side (11) and facing an inking roller (9), said doctor blade unit (1) including at least one doctor blade (7, 8, 32) securely, essentially irremovably seated in said structure and projecting from said cavity towards the inking roller (9) for stripping ink therefrom;

a carrier element (2) for said elongated structure including attachment means (15) for coupling the carrier element to the printing machine;

releasable interlocking attachment means (22–26) on said carrier element (2) and on said elongated structure (3, 4) forming the chambered doctor blade unit for releasably coupling the entire chambered doctor blade unit (1) to the carrier element and hence to the printing machine;

an ink supply opening formed in said chambered doctor blade unit (1) and terminating in a rear or bottom wall (10) defining said cavity (1'), said ink supply opening comprising an elongated ink supply and distribution slit (12) extending along a major portion of said elongated structure;

an ink distribution and supply connection (16) coupled to the elongated structure, fitting against the rear wall thereof, and expanding funnel-like to cover said elongated ink supply and distribution slit;

wherein said releasable interlocking attachment means comprises at least one rotatable pin (22) positioned on the carrier element (2), and having an eccentrically projecting locking cam (23) formed thereon;

and wherein at least one projecting bolt (24) extends from a surface (10) of the chambered doctor blade unit (1), said bolt being formed with at least one groove or recess (25) dimensioned and positioned for interengagement with the projecting cam (23) of the pin (22) upon rotation of the pin.

11. The printing machine of claim 10, wherein said carrier unit (2) is formed with a flat base plate (13) facing the chambered doctor blade unit (1); and the chambered doctor blade unit (1) is formed with a smooth end wall (10) for engagement against said flat plate upon clamping of the doctor blade unit (1) by said interlocking, interengaging attachment means on said carrier unit.

12. The printing machine of claim 10, wherein said chambered doctor blade unit comprises a shaped profile rail element (3) of generally U-shaped or channel-shaped cross section;

and end walls (4) separate from said rail element (3) fitted against a portion or section of said rail of predetermined length to close off said U-shaped or channel-shaped rail at the sides and define said ink chamber (1').

* * * * *